US009153149B1

(12) United States Patent
Curtiss

(10) Patent No.: US 9,153,149 B1
(45) Date of Patent: Oct. 6, 2015

(54) ILLUMINATED HAND-HELD ROAD SIGN

(71) Applicant: Michael Curtiss, Sunnyvale, CA (US)

(72) Inventor: Michael Curtiss, Sunnyvale, CA (US)

( * ) Notice: Subject to any disclaimer, the term of this patent is extended or adjusted under 35 U.S.C. 154(b) by 94 days.

(21) Appl. No.: 14/021,418

(22) Filed: Sep. 9, 2013

Related U.S. Application Data

(60) Provisional application No. 61/700,002, filed on Sep. 12, 2012.

(51) Int. Cl.
*G09F 21/02* (2006.01)
*G09F 13/00* (2006.01)

(52) U.S. Cl.
CPC ..... *G09F 13/005* (2013.01)

(58) Field of Classification Search
USPC ..... 40/586, 612; 116/63 P; 340/908
See application file for complete search history.

(56) References Cited

U.S. PATENT DOCUMENTS

| | | | | |
|---|---|---|---|---|
| 3,279,110 | A | 10/1966 | Lelicoff | |
| 3,810,091 | A | 5/1974 | Hoover | |
| 3,821,860 | A | 7/1974 | Patty | |
| 4,042,919 | A | 8/1977 | Patty | |
| 4,587,755 | A | 5/1986 | Sunshine | |
| 6,035,567 | A * | 3/2000 | Cameron | 40/607.04 |
| 6,107,941 | A * | 8/2000 | Jones | 340/915 |
| 6,134,819 | A | 10/2000 | McClain et al. | |
| 6,150,957 | A | 11/2000 | Henz et al. | |
| 6,266,903 | B1 | 7/2001 | Collins | |
| 7,497,040 | B2 * | 3/2009 | Chambless | 40/586 |
| 7,856,747 | B2 * | 12/2010 | Haubrich | 40/612 |
| 2012/0262304 | A1 * | 10/2012 | Cripps | 340/908 |

* cited by examiner

*Primary Examiner* — Joanne Silbermann
(74) *Attorney, Agent, or Firm* — Robert C. Montgomery; Montgomery Patent Design, LP

(57) ABSTRACT

An illuminated road sign has reflective lettering on each side, a plurality of illumination devices, and a battery-powered controller. The illumination devices are arranged along the perimeter of each face of the sign, are powered by the battery or with solar cell in an alternate embodiment, and are controlled by switches located on the handle of the sign assembly. The sign may be supported by a tripod structure portion that enables the sign to be utilized in a stand-alone state.

9 Claims, 6 Drawing Sheets

ILLUMINATED HAND-HELD ROAD SIGN

RELATED APPLICATIONS

The present invention was first described in and claims the benefit of U.S. Provisional Application No. 61/700,002, filed Sep. 12, 2012, the entire disclosures of which are incorporated herein by reference.

FIELD OF THE INVENTION

The present invention relates to a hand-held road sign further having an illumination means located thereon.

BACKGROUND OF THE INVENTION

Construction on roads is a common occurrence. Sometimes, the construction needs to be performed on roads that are still in use. The most common method of doing this is to block off part of the road and provide traffic control. The traffic control is most commonly conducted by a pair of construction personnel communicating together to allow traffic to flow on one (1) side and halting traffic on the other, then reversing this action as required. The use of hand-held signs, usually indicating "STOP" and "SLOW" on reversible sides, accomplishes this task. Personnel directing traffic is an inherently dangerous activity, especially if conducted at night or in low light level conditions. Accordingly, there exists a need for a means to provide a safe and effective method for directing the flow of traffic under these conditions. The development of the present invention fulfills this need.

Prior art in this field consist of simplistic posts having a sign affixed thereto or complex, heavy devices Simplistic posts devices provide no illumination. Some of these simplistic post devices have stands about which a user can rotate the post and have it stand freely, but none incorporate the lighting means and features that the present invention does. Complex, heavy devices are expensive and unwieldy. Furthermore, many complex devices are not suitable for a single user. It is an object of this invention to provide a road sign having an illumination means to display the command signs for directing traffic during low-light conditions.

It is a further object of this invention to provide a means to control the illumination of the signs.

It is a further object of this invention to provide a means to selectively employ the apparatus in a hand-held version or a freestanding version.

A further objective is to provide a means to supply the apparatus with a renewable source of electrical energy. A beneficial aspect of this invention is to provide a means to compactly stow the apparatus for ease of transport.

The apparatus comprises a sign assembly, having illuminating sources in connection with a rechargeable battery source and solar cells. Once illuminated, the indicia of the sign are enhanced, allowing a user to direct and control the flow of traffic without the need of ambient light. The apparatus is provided with a set of bases that enables use of a hand-held version and a freestanding version. The device is a light-weight, simple, and effective means to enable a worker to adequately direct and control traffic in low-light situations.

SUMMARY OF THE INVENTION

The apparatus comprises a handle portion extending to, and being integral with, a sign panel portion. The handle is provided with an ergonomic grasping segment and a mode switching assembly. The interior of the handle houses the various electronics and microprocessors to enable command and control of the illumination of the apparatus. The mode switching assembly controls the electrical power being supplied to illumination sources that are disposed within the sign panel portion of the apparatus. The apparatus is further provided with solar cell panels and a rechargeable battery to collect solar light, convert it to electrical energy, and store that energy for later use. The sign panel portion comprises a shaped perimeter framework and a panel having colored backgrounds and indicia to assist with directing and controlling traffic. Illumination sources are placed within the perimeter edges of the sign panel portion to adequately illuminate the sign panel when activated by the mode switch. Software is employed to supply the microprocessors with the necessary algorithmic functions to receive, regulate, and distribute electrical power within the apparatus.

The configuration of the handle affords the employment of the apparatus in a freestanding manner or in a hand-held supported manner. The apparatus is provided with a two-base system to facilitate such a use. In a hand-held manner, a first base is used to insert the handle into and permit free rotation of the handle. In a freestanding manner, a second base, having a plurality of support legs, is used in conjunction with the first base. A user inserts the second base into the first base, allowing the bases to hold the apparatus upright, but also affording the ability to freely rotate the apparatus to effectively direct and control traffic. The support legs are foldable to facilitate easy and compact storage when not in use. In either embodiment, the power source and control equipment housed within the handle are exploited to illuminate the sign panel when desired. In either embodiment, a battery compartment door is accessible to replace the rechargeable battery held within, if the situation to replace the battery arises.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
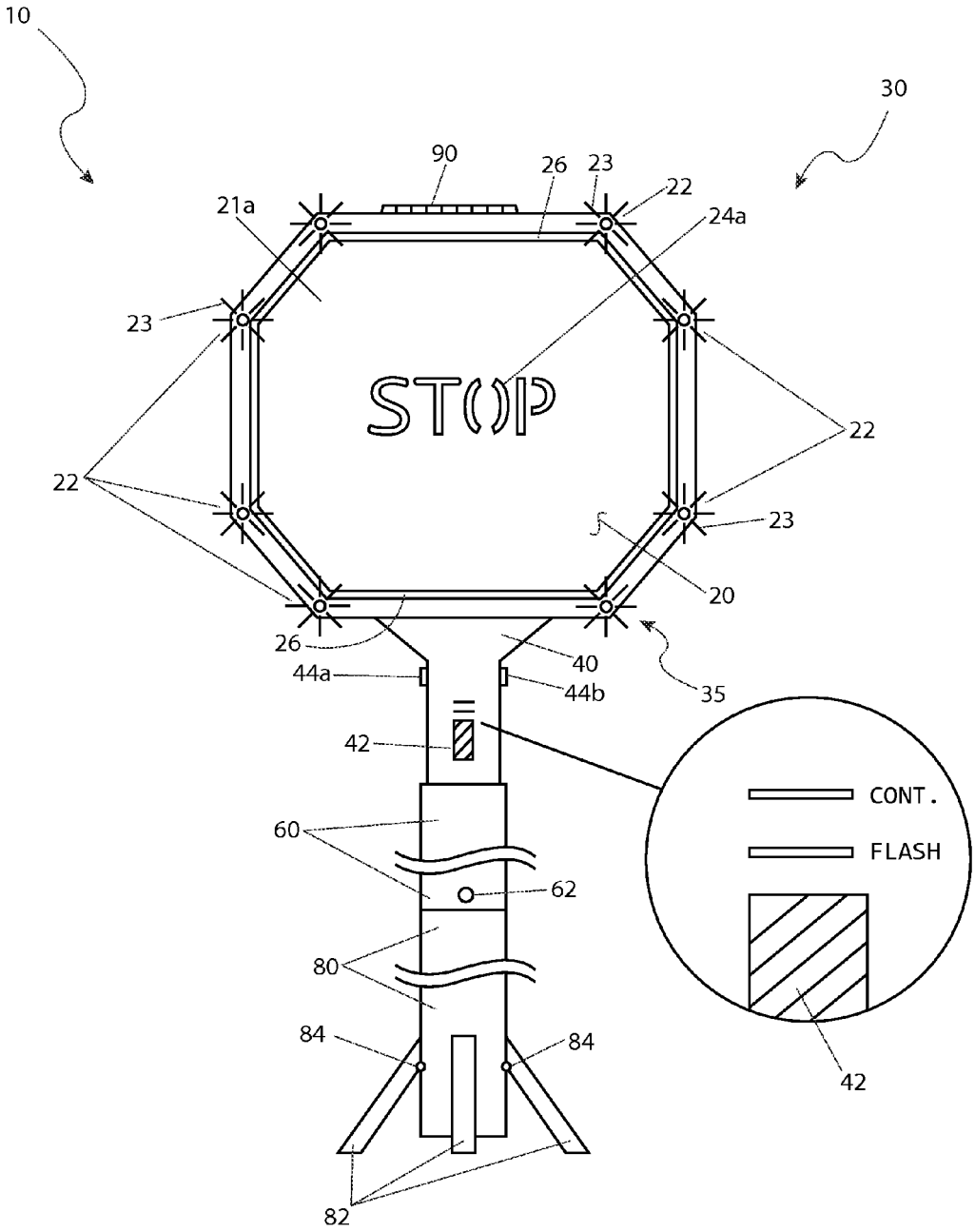
FIG. 1 is a front view of a first side portion 21*a* of an illuminated hand-held road sign 10, according to a preferred embodiment of the present invention.

10 illuminated hand-held road sign
20 sign panel

21*a* first side surface
21*b* second side surface
22 lamp
23 illumination
24*a* first indicia
24*b* second indicia
26 border
30 top portion
35 bottom portion
40 handle section
42 mode switch
44*a* first push button switch
44*b* second push button switch
60 first base section
62 spring fastener
63*a* button
63*b* fastening means
64 rotation feature
66 aperture
80 second base section
82 leg
84 hinge
90 solar cell
92 control module
93 battery
94 battery compartment door
96 wiring

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 2:
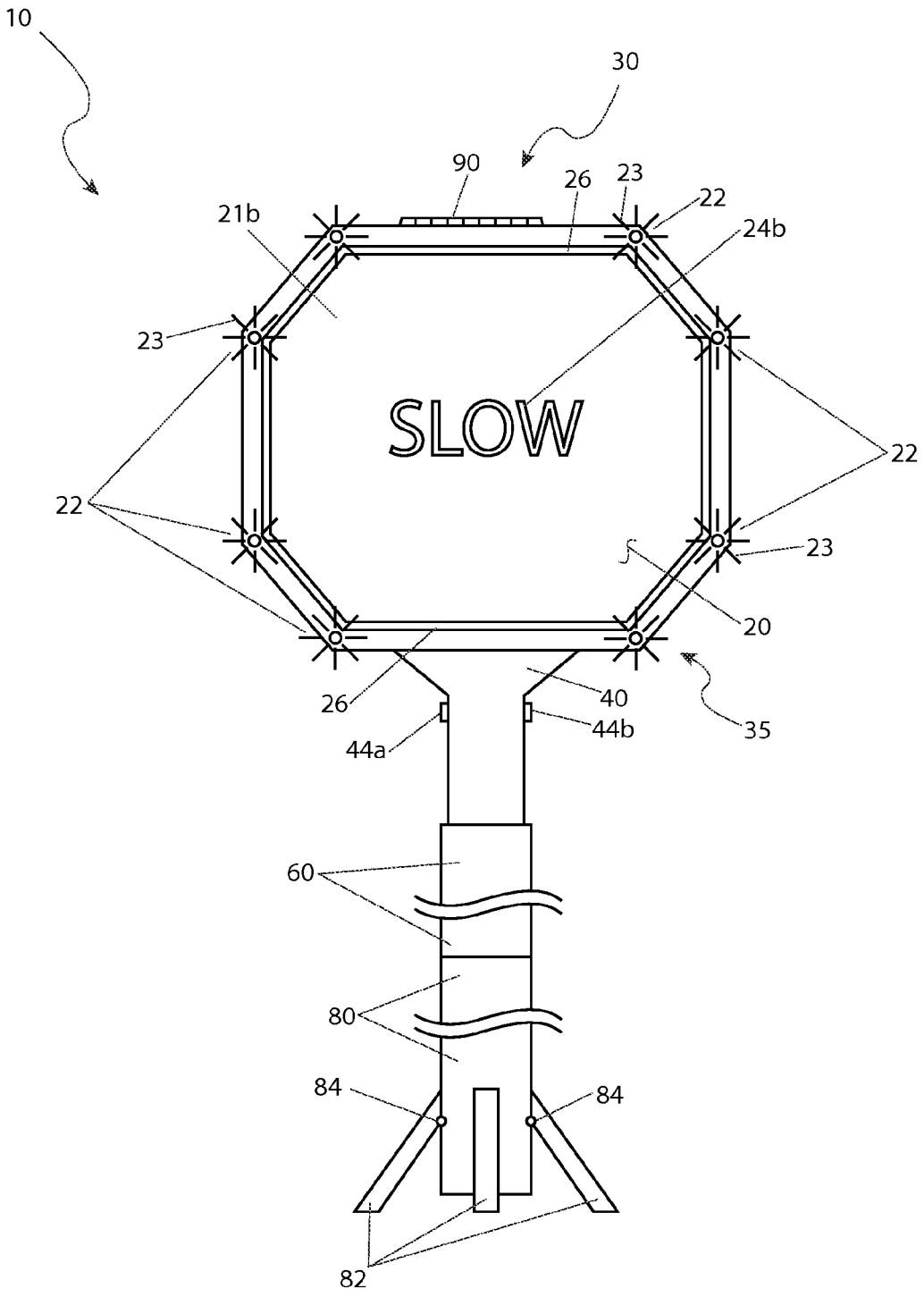
FIG. 2 is a front view of a second side portion 21*b* of the illuminated hand-held road sign 10, according to a preferred embodiment of the present invention.
Figure 3:
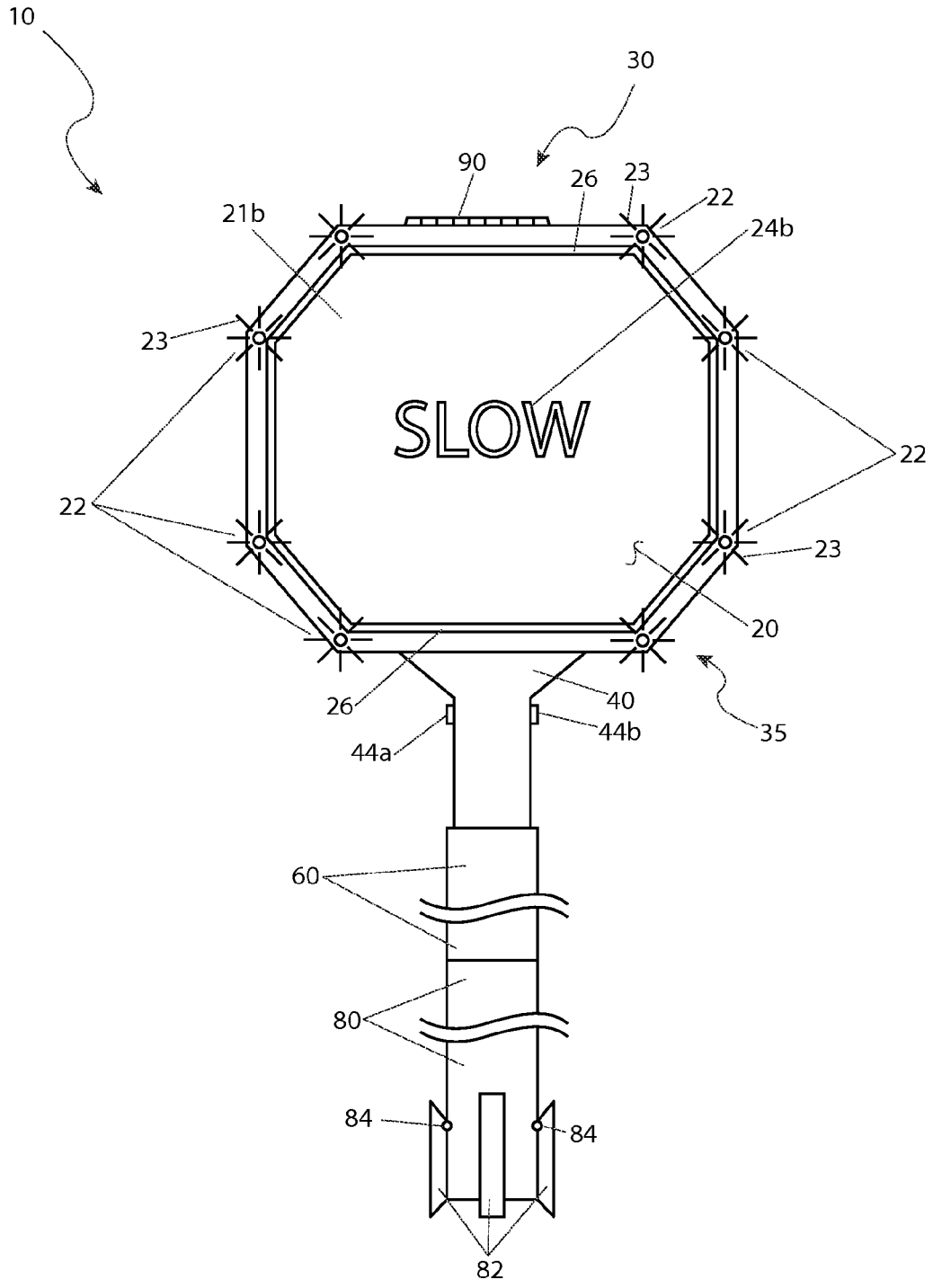
FIG. 3 is a front view of a second side portion 21*b* of the illuminated hand-held road sign 10, showing the legs 82 in a stowed position, according to a preferred embodiment of the present invention.

Referring now to FIGS. 1 through 3, views of first side surface 21*a* and second side surface 21*b* portions of the illuminated hand-held road sign (herein described as the "apparatus") 10, according to the preferred embodiment of the present invention, are disclosed. The apparatus 10 provides an illuminated road sign panel 20 preferably comprising appropriately shaped perimeter and background coloring portions which correspond to various warning or directing messages displayed thereupon. The sign panel 20 further comprises first 21*a* and second 21*b* side surfaces which provide respective permanently affixed first indicia 24*a* and second indicia 24*b* portions. The sign panel 20 further comprises a plurality of illuminating lamps 22 along perimeter edges upon both side surfaces 21*a*, 21*b*, and a top-mounted solar cell 90. Additionally, both side surfaces 21*a*, 21*b* provide border portions 26 being slightly inset from said illuminating lamps 22 which extend around and parallel to said perimeter edge portions.

The indicia 24*a*, 24*b* is envisioned to take the form of large alphanumeric lettering which depict common traffic control messages such as, but not limited to: "stop", "slow", "caution", "10 MPH", and the like. The lamps 22 are arranged along perimeter edges of each surface 21*a*, 21*b* of the apparatus 10 to provide advance warning to approaching motorists. The side surfaces 21*a*, 21*b*, borders 26, and indicia 24*a*, 24*b* are envisioned to be made using contrasting and correctly colored reflective and non-reflective materials such as adhesively bonded vinyl or other polymer material in accordance with applicable governmental regulations.

The lamps 22 are preferably flush-mounted light-emitting-diodes (LED) being powered by a top-mounted photovoltaic solar cell 90 and/or an internal rechargeable batteries 93. The solar cell 90 collects solar energy which in turn provides a charging current to at least one (1) rechargeable battery 93 located within a handle section 40 of the apparatus 10. The illumination 23 from the lamps 22 is to be controlled via a mode switch 42 and a pair of lamp activating push button switches 44*a*, 44*b* (see FIG. 4*a*).

The handle section 40 is integral to and extends downwardly from a bottom edge of the sign panel 20. The handle section 40 forms a hollow ergonomic cylindrical grasping portion of the apparatus 10. The handle section 40 further comprises a multi-positional sliding mode switch 42 allowing selection of various illumination functions of the lamps 22 such as, but not limited to: "power off", "flash" mode, and a continuous ("cont.") illumination mode. The lamp activating push button switches 44*a*, 44*b* activate the lamps 22 located upon respective side surfaces 21*a*, 21*b* of the sign panel 20 in an independent manner (also see FIG. 4*a*).

The handle section 40 allows an operator to hold and support the sign panel 20 or may be utilized in a "free-standing" manner via removable insertion into a subjacent first base section 60. The first base section 60 and conjoined second base section 80 portion combine to provide a stationary multi-leg structure, thereby allowing an operator to rest the sign panel 20 and handle 40 portions within, and allow the operator to rotate the sign panel 20 in a desired orientation as needed, so as to direct a desired surface 21*a*, 21*b* of the sign panel 20 toward oncoming traffic. The first base section 60 acts to upwardly extend the second base section 80, being removably attached to said second base section 80 via a spring fastener 62 which provides disassembly and compact storage (see FIG. 4*b*).

The sign panel 20 and handle section 40 may be used in a "hand-held" manner or in conjunction with the multi-leg-style first 60 and second 80 base sections in a "free-standing" manner. The second base section 80 is affixed to the first base section 60 in a linear manner to allow a user to support the apparatus 10, when desired.

The second base section 80 comprises a tubular structure further comprising a plurality of folding leg portions 82 along a bottom end being pivotingly affixed thereto via respective hinge portions 84, thereby enabling compact folded storage of the legs 82 against the second base section 80 (see FIG. 3).

Figure 4A:
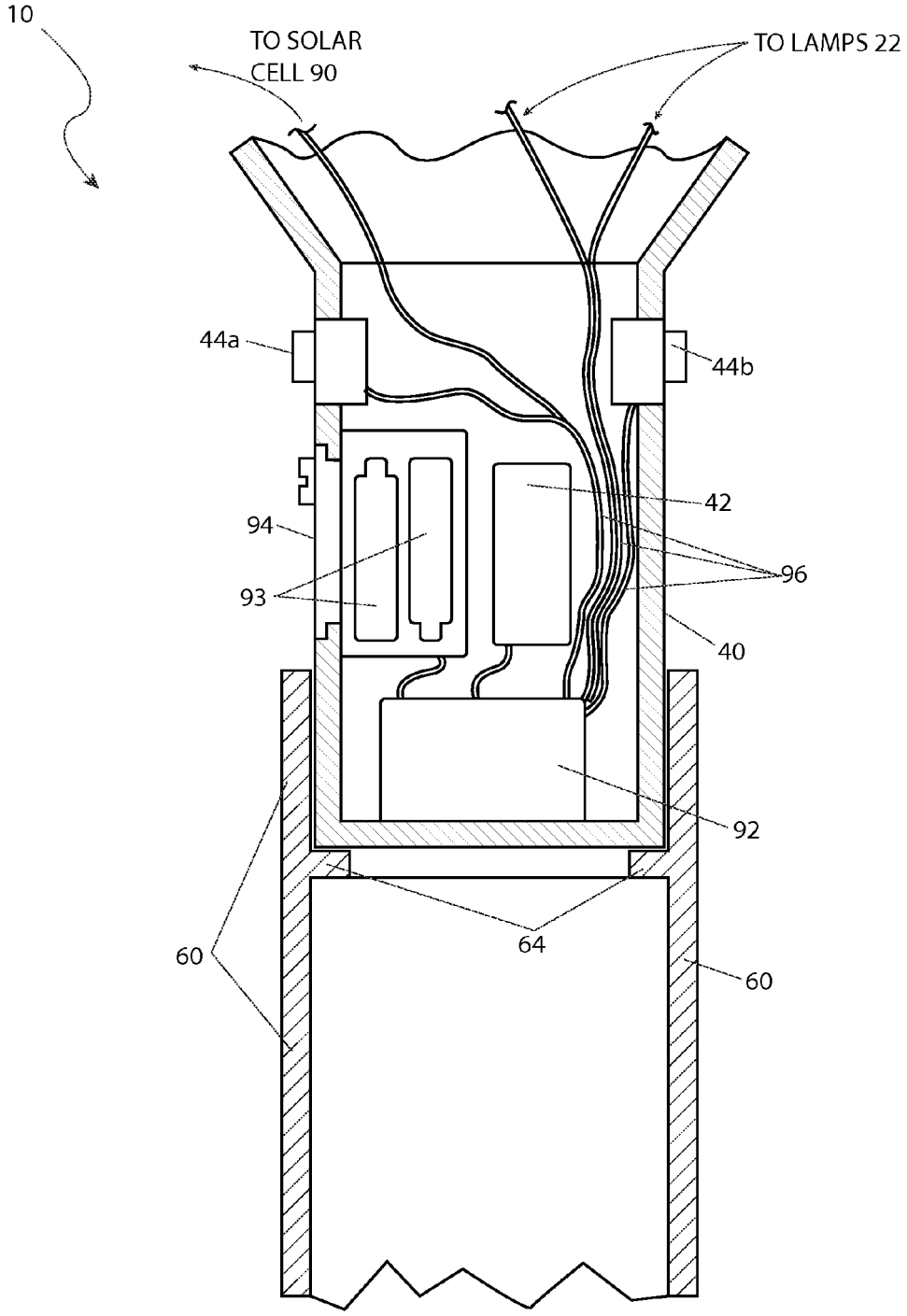
FIG. 4*a* is a partial sectional view of the illuminated hand-held road sign 10 taken along section line A-A (see FIG. 1), according to a preferred embodiment of the present invention.

Referring now to FIG. 4*a*, a partial sectional view of the apparatus 10 taken along section line A-A (see FIG. 1), according to a preferred embodiment of the present invention, is disclosed. The apparatus 10 provides internal power and control equipment to illuminate 23 the lamps 22, including the aforementioned mode switch 40, a first push button switch 44*a* to energize lamps 22 located along the first side portion 21*a* of the sign panel 20, a second push button switch 44*b* to energize lamps 22 located along the second side portion 21*b* of the sign panel 20, a control module 92, and at least one (1) rechargeable battery 93.

The push button switches 44*a*, 44*b* are envisioned to comprise standard contact-closure components which provide an input signal, enabling the control module 92 to direct power to lamps 22 upon a selected side surface 21*a*, 21*b*. The apparatus 10 is powered by a rechargeable battery 93 located within the handle section 40 which may be accessed for replacement through a battery compartment door 94. The control module 92 is envisioned to comprise a microprocessor-based electronic device capable of regulating power from the aforementioned solar cell portion 90 to charge the battery 93. Additionally, the control module 92 comprises embedded software to direct current from the battery 93 to the lamps 22 in accordance with the positions of the switches 42, 44*a*, 44*b*, to produce a desired illuminated effect 23. All electrical and electronic portions of the apparatus 10 are to be connected internally using common insulated copper wiring 96.

The first base section 60 comprises a hollow cylindrical structure having an open-top design, in which an internal protruding annular rotation feature 64 is located at a recessed position within the first base section 60. The features of the first base section 60 allow insertion of, and rotating support of, a bottom edge portion of the handle section 40.

Figure 4B:
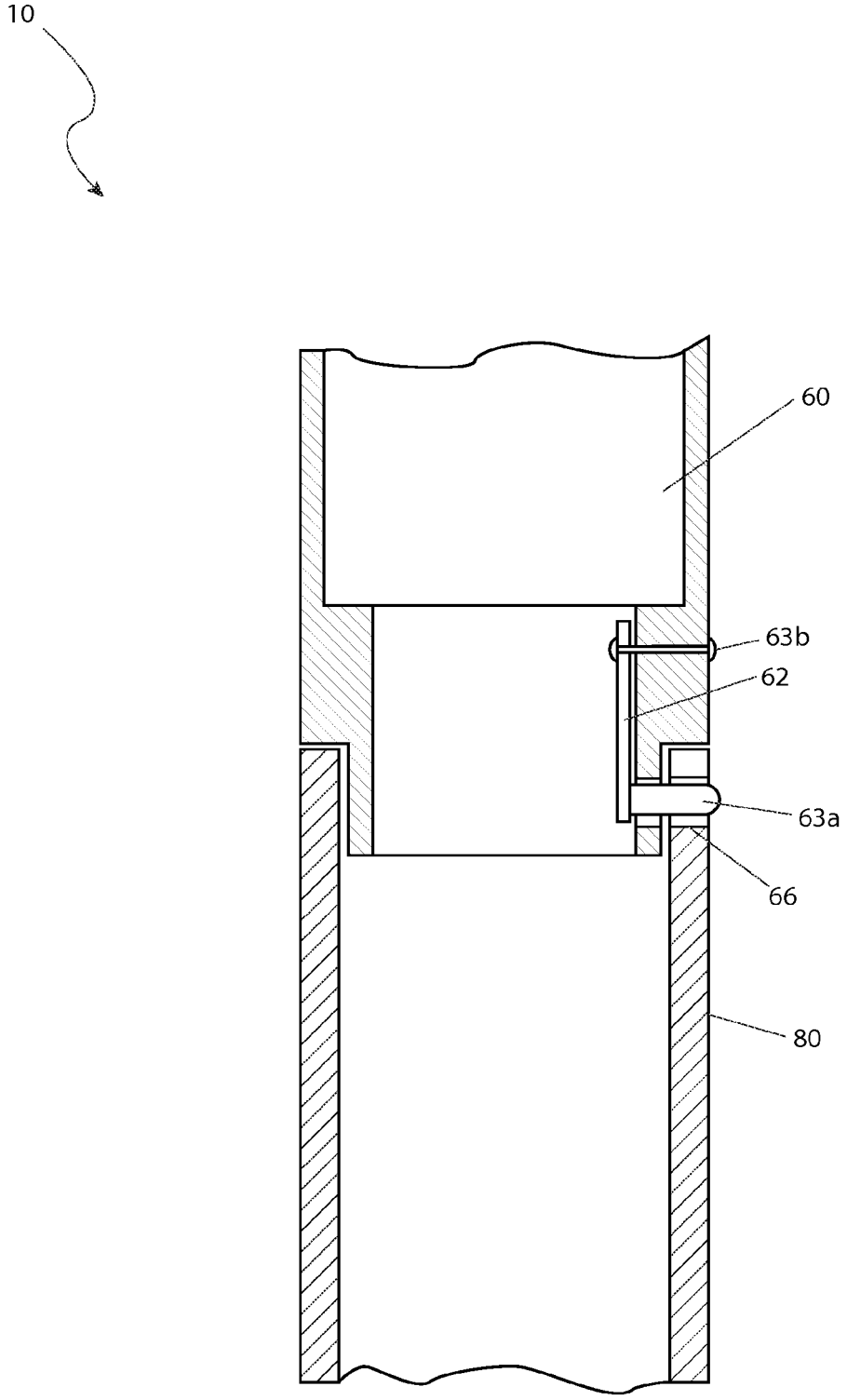
FIG. 4*b* is another partial sectional view of the illuminated hand-held road sign 10 also taken along section line A-A (see FIG. 1), depicting a first base section 60 and a second base section 80, according to a preferred embodiment of the present invention; and, FIG. 5 is an electrical block diagram of the illuminated hand-held road sign 10, according to a preferred embodiment of the present invention.

Referring now to FIG. 4*b*, another partial sectional view of the apparatus 10 taken along section line A-A (see FIG. 1), depicting a first base section 60 and second base section 80, according to a preferred embodiment of the present invention, is disclosed. The first base section 60 is removably attached to the second base section 80 via insertion and subsequent attachment using a spring fastener 62. Said features provide disassembly and compact storage of the apparatus 10. The spring fastener 62 preferably comprises a spring-loaded button-type fastener being mounted to an inner surface of the first base section 60 using a fastening means 63*b* such as a rivet, screw, or the like. The spring fastener 62 further comprises an integral and perpendicularly extending button portion 63*a* which protrudes through and engages an aperture portion 66 of the second base section 80, thereby allowing a user to depress the button 63*a* and remove the first base section 60. It is understood that other locking mechanisms may be provided which join the first base section 60 to the second base section 80 with equal benefit, and as such should not be interpreted as a limiting factor of the apparatus 10.

Figure 5:
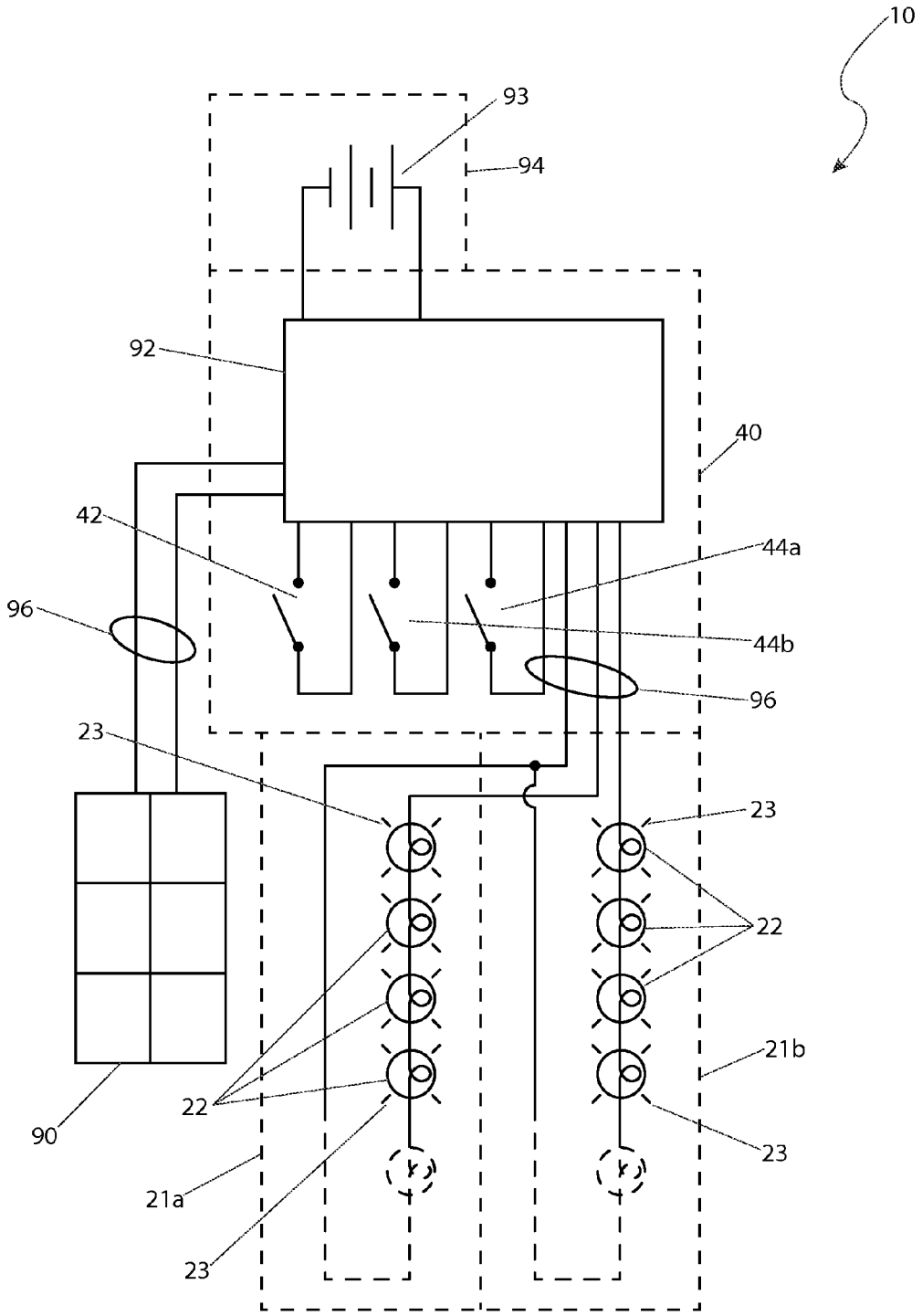

Referring now to FIG. 5, an electrical block diagram of the apparatus 10, according to a preferred embodiment of the present invention, is disclosed. The control module 92 comprises a microprocessor-based unit having embedded software capable of receiving, regulating, and distributing electrical power from the battery 93 and the solar cell 90 to both charge the battery 93 and to illuminate 23 particular groups of the lamps 22, based upon the positions of the mode switch 42 and the push button switches 44*a*, 44*b*.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 through 3.

The method of utilizing the apparatus 10 in a "hand-held" manner may be achieved by performing the following steps: procuring a model of the apparatus 10 having a desired perimeter shape, background color, and indicia portions 24*a*, 24*b* upon respective side surfaces 21*a*, 21*b*; loading at least one (1) rechargeable battery 93 into the handle section 40 using the battery compartment door 94; pre-charging the battery 93 or exposing the solar cell 90 to direct sunlight for a period of time until the battery 93 is charged; grasping the handle section 40 in one's hand; activating the apparatus 10 by sliding the mode switch 42 to select either the "flash" or "continuous" mode; activating illumination 23 of lamp portions 22 upon one (1) or both side surfaces 21*a*, 21*b* of the sign panel 20 by pressing respective push button switches 44*a*, 44*b*; directing a desired first 21*a* or second 21*b* side surface of the sign panel 20 toward oncoming vehicular traffic to communicate a warning; and, benefiting from enhanced traffic control afforded a user of the configurable and illuminated 23 present invention 10.

The method of utilizing the apparatus 10 in a "stand-alone" manner using the first base section 60 and second base section 80 portions may be achieved by performing the following steps: preparing the second base section 80 for use by extending the leg portions 82 from a collapsed state to an outwardly extended state by pivoting said legs 82 about the hinges 84 until obtaining a mechanically limited position; inserting a bottom end of the first base section 60 into the open-topped portion of the second base section 80; engaging and locking the spring fastener 62 portion of the first base section 60 through the aperture portion 66 of the second base section 80; inserting the handle section 40 into the top opening portion of the first base section 60; and, utilizing the apparatus 10 in a stable "stand-alone" manner to warn or direct oncoming traffic, as well as freeing-up an operator to perform additional tasks.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A road sign, comprising:

a sign portion, comprising:

a top portion;

a bottom portion;

a first side, further having first indicia thereon, a first illumination means located along a surface adjacent to a first side perimeter, said first illumination means for generating and emanating illumination therefrom;

a second side, further having second indicia thereon, a second illumination means located along a surface adjacent to a second side perimeter, said second illumination means for generating and emanating illumination therefrom; and, a solar electrical generating means located on said top portion of said sign portion for generating electricity;

a handle portion, having an upper end extending outwardly from said bottom portion;

a base removably attachable to a lower end of said handle portion, comprising:

a first base section comprising a hollow cylindrical structure having an open top;

an internal protruding annular rotation feature located at a recessed position within said first base section;

a second base section comprising a tubular structure having an open top removably attached to said first base section with an attachment means; and, a plurality of leg portions each pivotally attached to an outer surface of said second base section; and, a control means in electrical communication between said solar electrical generating means, said first illumination means, and said second illumination means, said control means located within said handle portion;

wherein said first base section receives said lower end of said handle portion such that said handle portion is rotatable relative to said base; and, wherein each of said plurality of leg portions is independently foldable to a stowed position where an inside surface abuts said outer surface of said second base section and a deployed position where a bottom surface contacts a ground surface.

2. The road sign of claim 1, further comprising:

first border indicia located on said first side such that said first illumination means is between said first side perimeter and said first border indicia; and, second border indicia located on said second side such that said second illumination means is between said second side perimeter and said second border indicia.

3. The road sign of claim 2, wherein said first and second indicia comprises large alphanumeric lettering which depict a traffic control message.

4. The road sign of claim 2, wherein said first side, second side, first indicia, second indicia, first border indicia, and second border indicia comprises contrasting reflective and non-reflective materials.

5. The road sign of claim 2, wherein said first and second illumination means are each flush-mounted light-emitting-diodes.

6. The road sign of claim 1, wherein said handle portion further comprises a hollow ergonomic cylindrical body.

7. The road sign of claim 1, wherein said control means further comprises:

a power supply in electrical communication with said solar electrical generating means;

a control module in electrical communication with said power supply;

a mode switch in electrical communication with said control module;

a first activating switch in electrical communication with said control module; and, a second activating switch in electrical communication with said control module;

wherein said solar electricity generating means supplies power generated therefrom to said power supply;

wherein said first activating switch control said first illumination means;

wherein said second activating switch control said second illumination means;

wherein said control module stores various illumination functions of both said first illumination means and said second illumination means; and, wherein said mode switch selectively switches between said various illumination functions.

8. The road sign of claim 1, wherein said various illumination functions comprises the following list: a "power off" mode, a "flash" mode, and a continuous illumination mode.

9. The road sign of claim 1, wherein said attachment means is a spring fastener mounted to an inner surface of said first base section having an button portion extending outwardly therefrom, and an aperture portion located on said second base section;

wherein said button portion is biased to protrude through said aperture portion when aligned therewith.

* * * * *